United States Patent [19]

Lanzi et al.

[11] 4,270,266

[45] Jun. 2, 1981

[54] METHOD OF MAKING A DIELECTRIC CONTAINING MATERIAL FOR RF SUPPRESSION

[75] Inventors: Ronald G. Lanzi, Mt. Clemens; Peter Vernia, Rochester, both of Mich.

[73] Assignee: General Motors Corporation, Detroit, Mich.

[21] Appl. No.: 942,425

[22] Filed: Sep. 14, 1978

[51] Int. Cl.[3] ..... H01R 43/00

[52] U.S. Cl. ..... 29/875; 264/61; 427/123; 200/19 DR; 200/275

[58] Field of Search ..... 310/70 R, 70 A; 29/630 C, 625, 875; 200/275, 19 DR; 264/61, 65, 67, 104; 427/96, 101, 123; 65/18

[56] References Cited

U.S. PATENT DOCUMENTS

| | | | |
|---|---|---|---|
| 1,922,221 | 8/1933 | Steenbeck et al. | 65/18 X |
| 2,993,815 | 7/1961 | Treptow | 427/96 X |
| 3,359,623 | 12/1967 | Gwyn, Jr. | 29/650 C X |
| 3,382,066 | 5/1968 | Kenney et al. | 29/630 C X |
| 3,506,437 | 4/1970 | Gwyn, Jr. | 29/630 C X |
| 3,523,357 | 8/1970 | Meyer | 65/18 X |
| 3,600,530 | 8/1971 | Dusenberry et al. | 310/70 A X |
| 3,685,134 | 8/1972 | Blue | 29/630 C X |
| 3,863,337 | 2/1975 | Schreiner et al. | 29/630 C |
| 3,864,827 | 2/1975 | Schreiner et al. | 29/630 C |
| 4,072,771 | 2/1978 | Grier, Sr. | 427/101 X |
| 4,129,107 | 12/1978 | Boyer | 310/70 R X |
| 4,175,144 | 11/1979 | Hori et al. | 427/101 X |

FOREIGN PATENT DOCUMENTS

| | | | |
|---|---|---|---|
| 1496691 | 7/1971 | Fed. Rep. of Germany . | |
| 363615 | 12/1931 | United Kingdom | 252/512 |

*Primary Examiner*—Lowell A. Larson
*Assistant Examiner*—C. J. Arbes
*Attorney, Agent, or Firm*—Elizabeth F. Harasek

[57] ABSTRACT

A novel distributor rotor electrode material is provided and a method for making it. A mixture comprised of at least half copper oxide and a minor portion of silica or silica and alumina is fused to form a friable glassy material. The copper oxide of the material is reduced to copper metal, the material in the solid state then being characterized by a substantially continuous microphase of sponge-shaped glassy bodies with copper retained in the interstices thereof. When the material is sintered into a rotor electrode body, the sponge-shaped bodies become strongly mechanically retained in a substantially continuous metal matrix providing the electrode with outstanding resistance to spark erosion.

3 Claims, 6 Drawing Figures

METHOD OF MAKING A DIELECTRIC CONTAINING MATERIAL FOR RF SUPPRESSION

BACKGROUND OF THE INVENTION

This invention relates to a method of making improved ignition distributor rotor electrodes for internal combustion engines. The electrodes have dielectric material containing particles dispersed in a conductive metal for the purpose of substantially suppressing the generation of radio frequency signals. More particularly, the invention relates to making distributor rotor electrodes wherein the dielectric material retained in the RFI suppressing particles is present in the form of sponge-like microscopic bodies with copper metal in the pores. When such particles are sintered with additional metal powder, the copper from the particles fuses therewith so that the sponge-like dielectric bodies are strongly mechanically interlocked with a substantially continuous metal matrix.

Radio frequency interference (RFI) in vehicles powered by spark ignition internal combustion engines is caused, for the most part, by high voltage spark discharges across the rotor gap. The RFI source is a large, fast rise time impulsive current generated at the onset of the rotor gap breakdown. The higher the voltage required to break down the gap, the higher the intensity of the radio frequency interference noise. It is known that the breakdown voltage across a given rotor gap can be lowered by providing a source of initiatory electrons, e.g., a dielectric material, at the surface of the rotor electrode at the gap. It is theorized that these electrons are accelerated away from the electrode tip by the application of an electric field to collide with air molecules in the gap and ionize them. The presence of these ions increases the probability that the rotor gap will break down at a lowered voltage where RFI is substantially suppressed.

Certain prior art RFI suppressing rotor electrodes comprised sintered mixtures of dielectric silica or glass particles, in the form of generally point symmetrical round powder or line symmetrical short fibers, and metal powder. Although such electrodes would suppress RFI noise generation, sparking at the rotor gap could dislodge the regularly shaped dielectric particles and cause excessive electrode wear, noise in the FM frequency band, and shortened service life.

It is an object of this invention to provide a novel two phase (dielectric phase-conductive metal phase) material which, when incorporated in an ignition distributor rotor electrode, provides durability and substantially suppresses radio frequency interference. It is a more particular object to provide an RFI suppressing rotor material wherein dielectric bodies of silica or silica and alumina are present in the material in the form of sponge-like or lacy dielectric elements with copper metal filling in the interstices. It is another object to provide a method of making and of incorporating such two phase material into a metal rotor electrode by substantially fusing the copper from the RFI suppressing material with additional metal powder to form a substantially continuous metal matrix in which the sponge-like dielectric elements are securely retained. Our rotor electrodes are highly resistant to spark erosion and wear due to improved retention of the dielectric element in the matrix metal.

BRIEF SUMMARY OF THE INVENTION

In accordance with a preferred embodiment of the invention, these and other objects are accomplished as follows. A mixture, comprising by weight, at least half copper oxide and a minor portion of silica or silica and alumina, preferably about 5 to 20 weight percent silicon oxide ($SiO_2$) and from 0 to 10 percent aluminum oxide ($A1_2O_3$) is fused. Upon cooling, a friable glassy material with separate, substantially non-crystalline, cuprous oxide and silica-alumina microphases forms. Particles of this multiphase material are then subjected to a chemically reducing atmosphere at an elevated temperature for a time sufficient to selectively reduce the cuprous oxide phase to copper metal. These treated particles exhibit a microstructure comprising a minor first microphase of sponge-like or lacy substantially continuous dielectric silica-alumina glassy bodies, said bodies being firmly mechanically interlocked with a second major copper metal microphase which fills their interstices.

The reduced metal-silica composite particles are then comminuted to a fine powder, preferably about −200+325 mesh, and mixed with copper powder or other conductive metal powder of similar mesh. Preferably, the metal-silica composite powder comprises about 5 to 20 weight percent of the mixture to achieve a final nonmetallic dielectric content in the sintered electrode of from about 0.5 to 5 weight percent. The powder mixture is then pressed substantially into the shape of a desired rotor electrode and sintered to form a densified, wear resistant, rotor segment by well known powder metallurgy techniques. Sintering causes the metal phase of the composite powder to fuse with the copper metal powder. Thus, the microstructure of the sintered segment consists of a major portion of a substantially continuous copper phase in which lacy, sponge-like dielectric silica glass bodies are strongly mechanically retained. The physical structure of the bodies prevents them from being easily dislodged at the rotor electrode spark surface. Thus, electrodes made according to the invention are much more durable and less prone to spark erosion than those wherein a dielectric portion is retained as spheres, cylinders, or other such regularly shaped bodies.

The invention will be more fully appreciated and clearly understood from a detailed description which follows. Reference will be made to the drawings in which.

Figure 1:
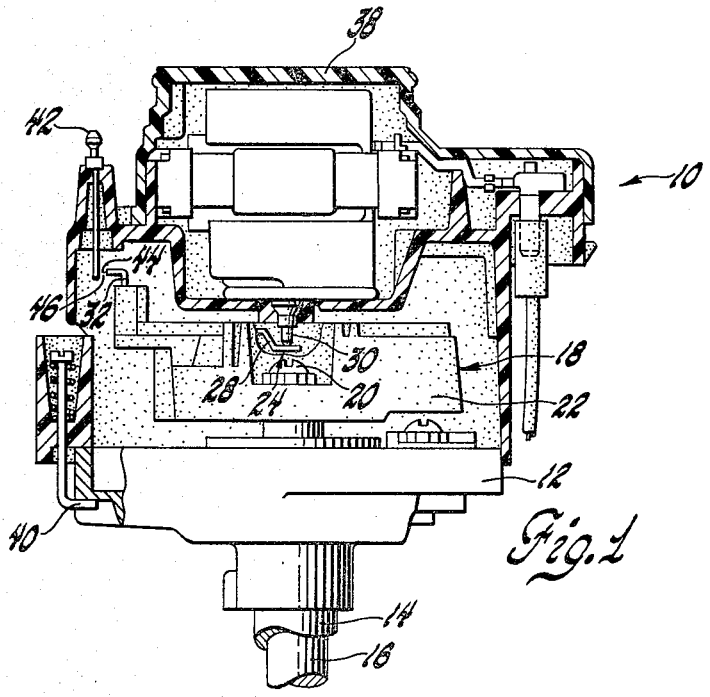
FIG. 1 is an elevational view, partly broken away and in section, of an ignition distributor for an internal combustion engine containing a rotor electrode made according to the invention. The electrode is shown in spark gap relation to a stationary spark plug cable electrode.

In a preferred embodiment and referring to FIG. 1, a view of a typical automobile ignition distributor 10 is shown. A distributor housing 12 is mounted on a stationary rotor shaft casing 14. Confined within casing 14 is rotor driving shaft 16 which is generally gear coupled with the engine cam shaft. A rotor 18 is mounted by screws 20 on driving shaft 16 to rotate therewith. Rotor 18 of distributor 10 comprises an insulating base 22, generally molded from an electrically nonconductive thermoplastic molding material, and a two-part conductive rotor electrode 24 mounted thereon (best seen at FIG. 2). Electrode 24 extends radially outward from rotational center 26 of rotor 18 to slightly beyond the outside perimeter of base 22. In the illustrated embodiment of the invention, the radially inward portion 28 of electrode 24 is a flat stainless steel strip which is slightly bent to bias against protruding secondary coil high tension electrode 30, assuring electrical contact therebetween. As clearly seen at FIG. 3, the radially outward portion 32 of electrode 24 is clamped against radially inward portion 28 by tab 34. An electrical connection is formed between the two electrode portions at interface 36. The radially outward electrode portion 32 is made according to the invention to contain microscopic irregularly shaped dielectric bodies in a fused metal phase. Obviously, other rotor and rotor electrode designs would be equally suited to the practice of the invention.

Referring to the cut-away section of FIG. 1, an ignition distributor cap 38 is mounted on distributor rotor housing 12 by means of spring loaded clips 40. A plurality of high tension spark plug cable lead terminals 42 are mounted in cap 38 in a circular pattern. During operation, a spark plug is electrically connected to each spark plug cable terminal 42 by a suitable connector cable (not shown). The terminals are positioned in cap 38 so they successfully come into spark gap relation with rotor electrode 24 driven by shaft 16. The space between the outboard end 44 of electrode 24 when it is substantially radially aligned with a spark plug cable lead 42, is referred to as the rotor gap 46. A high energy ignition spark generated across gap 46 induces a high voltage in the associated spark plug cable and fires the connected plug.

Figure 2:
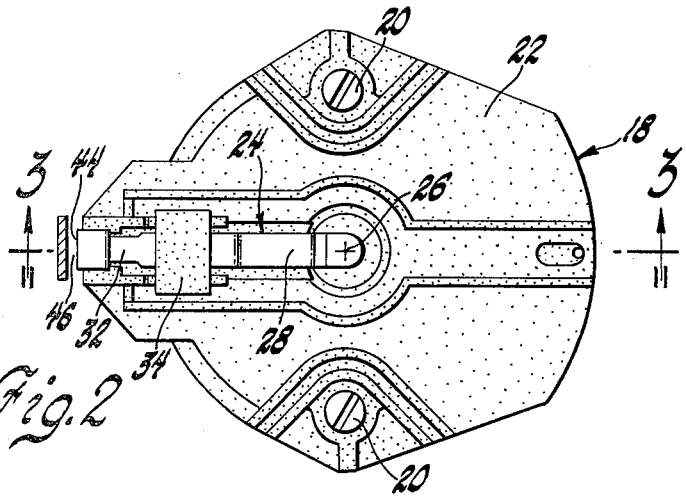
FIG. 2 is a plan view of the distributor rotor of FIG. 1.
Figure 3:
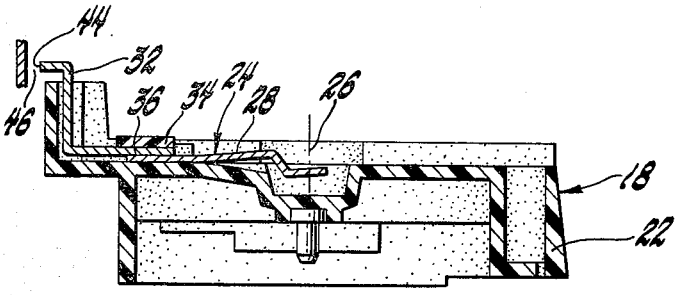
FIG. 3 is a sectional view of the rotor of FIG. 2 taken along line 3—3 looking in the direction of the arrows.

The operation of a distributor such as that shown in FIGS. 1 to 3 as it pertains to the practice of the invention can be briefly described as follows. As rotor 18 is turned by driving shaft 16, an electrical signal produced by suitable means passes therethrough to ground. The spark plugs are successively fired by interrupting the current flow to ground at about the time rotor electrode 24 is lined up directly with a spark plug cable lead terminal 42. This induces a high voltage in the secondary coil (not shown) and coil electrode 30. Current flows from the coil through rotor electrode 24 until the voltage becomes high enough to electrically break down gap 46. The spark generated across gap 46 causes a high tension current to flow through the associated spark plug cable to fire the connected plug.

The invention provides a method of making an improved rotor electrode of the type containing microscopic dielectric particles to lower breakdown voltages at the gap and suppress radio frequency noise. In the improved electrodes, the dielectric constituent is present in the form of microscopic sponge-like bodies durably retained in the electrically conducting medium. In accordance with the preferred practice of the invention, rotor electrodes were made as follows.

100 parts by weight cuprous oxide ($Cu_2O$) were combined with 10 parts by weight silicon oxide ($SiO_2$) and 5 parts by weight aluminum oxide ($A1_2O_3$). The mixture was heated in an Inconel® crucible to about 1,060° C. where it melted. The melting point of the glass is substantially lower than the melting points of the constituents: silica m.p. 1,710° C.; cuprous oxide, m.p. 1,210° C.; or alumina, m.p. 2,030° C. The heating was continued to a temperature of about 1,150° C. and the mixture was maintained thereat for about 1 hour. It was then poured into a second Inconel® crucible wherein it quickly cooled and solidified into a two-phase substantially non-crystalline material, the cuprous oxide comprising one phase, and the alumina and silica the other. Although this has been found to be a good method of cooling molten mixtures of constituents, the two-phase glasses have also been made by cooling a molten mixture in air in the melting crucible, slow cooling a mixture in the furnace, or simply pouring a mixture onto a slab of cold metal or concrete.

Figure 4:
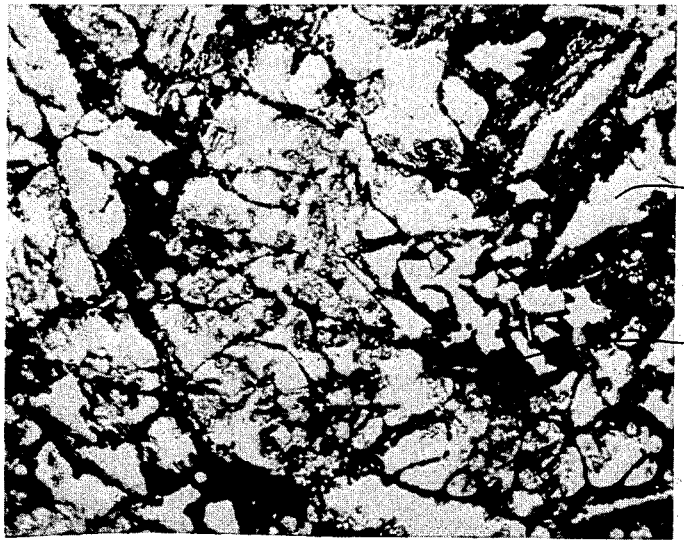
FIG. 4 is a photomicrograph of 500× magnification of a copper oxide-silica glassy material (in weight parts 100 copper oxide; 10 silica; 5 alumina) before reduction.

FIG. 4 is a photomicrograph at 500× magnification of the 100:10:5; $Cu_2O$:$SiO_2$:$Al_2O_3$ glass. The light colored areas 50 represent a cuprous oxide phase, while the darker regions 52 represent a silica and alumina phase.

Such two phase materials have also been formed from mixtures of cuprous oxide and up to 20 weight percent silica without alumina. Although glassy materials from mixtures of silica and other dielectric oxides have not actually been made, there is no reason to believe that oxides of other elements such as magnesium, gadolinium, zirconium, or titanium, e.g., would not be equally useful. Similarly, cuprous oxide has been employed as the reducible metal oxide for making rotor electrodes because it is relatively inexpensive and copper is a good electrical conductor. However, it is believed that the oxides of other conductive metals such as silver, iron, nickel or cobalt would perform as well. A factor that must be taken into consideration in choosing a "dielectric oxide"-"reducible oxide" mixture is that the dielectric oxide must be more difficult to chemically reduce than the oxide of the electrically conducting base metal.

After cooling, the above described glass was crushed into relatively fine particles to speed up the subsequent reduction process. The crushed particles were retained in a furnace at a temperature of about 700° C. for 30 minutes. The furnace atmosphere comprised Nitroneal® gas (95% nitrogen- 5% hydrogen), the hydrogen therein acting selectively as a reducing agent for the cuprous oxide at furnace temperatures. The dielectric constituents, alumina and silica, being more difficult to reduce, were unaffected by the hydrogen atmosphere. It will be appreciated that other reducing atmospheres would also be suitable for the practice of the invention.

After the particles were removed from the furnace and cooled, they were subjected to electron probe analyses for the elements copper, silicon, aluminum and oxygen. The results showed that the alumina and silica were present in one phase and the copper in another. Herein such silica containing phase may be referred to simply as the silica glass phase. No oxygen was detected in the copper phase, indicating that substantially all the cuprous oxide had been reduced.

Figure 5:
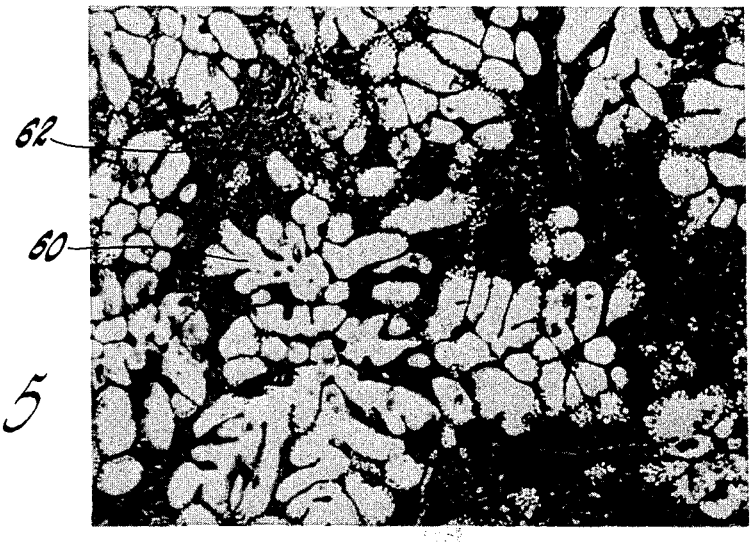
FIG. 5 is a photomicrograph of a copper oxide-silica glassy material like that of FIG. 4 after reduction of the copper oxide to copper showing the sponge-like silica based microphase.

FIG. 5 is a photomicrograph of the reduced two-phase metal-silica glass composite material at 500× magnification. The light colored portions 60 represent the copper metal phase, and the dark portions 62 the silica-alumina glass phase. It is readily seen that the glass phase 62 forms a substantially continuous lacy or sponge-like matrix of glass bodies interspersed with the predominant copper phase. Generally, the copper oxide should comprise at least half the weight of the original copper oxide-dielectric mixture to provide the characteristic sponge-like glassy microphase in the reduced material.

The relative weight percents and volume percents of each constituent of the above described reduced metal-glass composite material are given in Table I. Knowing the starting weight of each constituent oxide, in this case 100 pbw $Cu_2O$, 10 pbw $SiO_2$, and 5 pbw $Al_2O_3$, the percent amount of each constituent in the reduced metal-glass composite was calculated. The loss of oxygen from the reduction of the cuprous oxide was taken into account. The volume percent of each constituent was determined by dividing the weight percent of each constituent by its corresponding specific gravity (as given in the CRC Handbook of Chemistry and Physics) and normalizing to 100 total volume parts.

TABLE I

| Unreduced Glass | | Reduced Metal-Glass Composite | | | | |
|---|---|---|---|---|---|---|
| | pbw | | pbw | % weight | density | % volume |
| $Cu_2O$ | 100 | Cu | 88.8 | 85.6 | 8.92 | 66.1 |
| $SiO_2$ | 10 | $SiO_2$ | 10 | 9.6 | 2.65 | 25.0 |
| $Al_2O_3$ | 5 | $Al_2O_3$ | 5 | 4.8 | ~3.7 | 8.9 |

Rotor electrode segments were made by pressing the reduced metal-silica glass composite powder directly into a desired electrode shape and sintering. However, the compacts had insufficient green strength to allow for bulk handling and the sintered electrodes tended to be brittle. Thus, it is preferred to mix the metal-glass composite materials with an electrically conductive, malleable metal powder for pressing and sintering electrode shapes.

The two-phase composite powder described above was ground further, sieved, and the −200+325 mesh portion was retained. This powder was then mixed with −325 mesh atomized copper powder at the weight ratios of 20 parts reduced metal-glass composite to 80 parts copper; 10 parts reduced metal-glass composite to 90 parts copper; and 5 parts reduced metal-glass composite to 95 parts copper. Table II shows the relative weight percents and the volume percents of each constituent in these mixtures.

TABLE II

| Electrode Composition (pbw) | | | | | | | |
|---|---|---|---|---|---|---|---|
| Copper Powder | Copper-Glass Composite Powder | % weight | | | % volume | | |
| | | Cu* | $SiO_2$ | $Al_2O_3$ | Cu* | $SiO_2$ | $Al_2O_3$ |
| 80 | 20 | 97.11 | 1.92 | 0.96 | 91.7 | 6.1 | 2.2 |
| 90 | 10 | 98.56 | 0.96 | 0.48 | 95.8 | 3.1 | 1.1 |
| 95 | 5 | 99.28 | 0.48 | 0.24 | 97.9 | 1.6 | 0.5 |

*Total copper content of rotor electrode including contributions from copper powder and copper portion of composite powder.

The mixtures were compacted in a die having substantially the shape of the desired electrode, with allowance for shrinkage upon sintering, at pressures of about 275 to 425 megapascals (MPa). The compacts had good green strength and were easily handled. They were sintered for 30 minutes at 925° C. in a 95% nitrogen-5% hydrogen atmosphere. Sintering caused the copper powder to fuse with copper phase of the metal-glass composite powder thereby creating strong mechanical bonds between the minor portion of sponge shaped silica glass bodies and the fused metal. Where the reduced metal-silica composite material is comprised of a major phase or portion of metal and a minor phase of glassy, silica, the above mentioned fusion effect brought about by sintering is believed to provide particularly strong and spark erosion resistant rotor electrode materials. Hydrogen is a preferred sintering gas, however, any gaseous atmosphere which is unreactive with the constituents at sintering temperatures would be appropriate.

The sintered compacts were suitable for use as is on a distributor rotor without further processing. The sintered bodies were strong and ductile enough to be poured into storage bins, positioned by hand or machine in rotors, and, if necessary, bent into place on a rotor without breaking.

Figure 6:
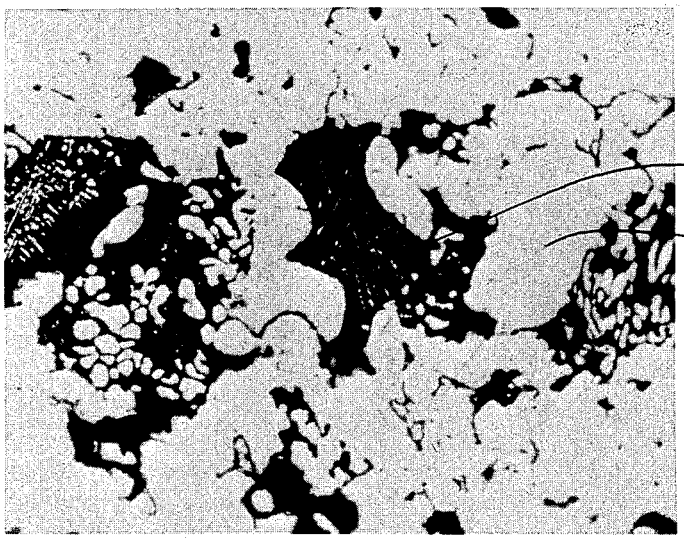
FIG. 6 is a photomicrograph at 500× magnification of a section of a sintered copper rotor electrode wherein reduced copper-silica particles, like those shown in FIG. 5 have been dispersed.

FIG. 6 is a photomicrograph at 500× magnification of a sintered rotor electrode formed as above. The dark portions 70 represent irregularly shaped silica bodies. The light areas represent a fused copper matrix 72. It is the irregular lacy shape of bodies 70 which causes them to be so firmly mechanically embedded in copper matrix 54 that they are particularly resistant to erosion caused by sparking at a rotor gap.

Electrodes of each of the metal-glass composite and copper powder ratios, i.e., 20:80, 10:90, and 5:95, were tested in a high energy automobile ignition distributor such as that shown in FIG. 1. The distributor was mounted in bench service testing equipment which simulates distributor operation in an automobile ignition system under controlled conditions. A spindle, corresponding to the rotor driving shaft in an automobile, was set to rotate the rotor at 1,750 revolutions per minute (rpm) and the primary distributor coil was connected to a 12V D.C. source. The distributor output terminals were shorted together and connected to ground through standard television and radio suppression (TVRS) spark plug cable. Testing was done with vacuum advance adjusted so that sparking occurred along the surface of the rotor electrode tip at the gap. The voltage at the rotor tip was monitored on an oscilloscope as a function of time. A Stoddart spiral cone antenna (No. 93490-1,200–1,000 MHz) was placed in near field and interphased with a Hewlett Packard 8551-A Spectrum Analyzer to monitor the RFI noise at frequencies in the range of 0 to 1,000 MHz. The RFI noise output was measured on the spectrum analyzer in the range of from 0 to 40 decibels above one microvolt per meter per kilohertz (relative db). One hour of bench testing in this apparatus is roughly equivalent to 100 miles normal service in an automobile.

Throughout testing, the breakdown voltage for each electrode was measured to be about 8 kV or less compared to breakdown voltages of the same gap with a plain copper rotor electrode of about 20 kV. The RKI output of each electrode was judged quiet as measured by the spectrum analyzer, generally averaging less than 10 relative db over the entire 1,000 MHz frequency range. A 20% reduced glass, 80% copper powder electrode was run for 625 hours (equivalent to about 62,500 in-car miles) without any substantial electrode wear or increase in RFI noise. The experiment was stopped only to free the testing equipment, the spark wear being so minimal that the electrode could have stood up to much more service.

Another rotor electrode made as above and comprising a 20% reduced glass-80% copper mixture was placed in a late model eight cylinder automobile equipped with a standard Delco® high energy ignition distributor. The electrode was tested therein for radio frequency interference noise using SAE test procedure J-551c. Briefly, the test procedure entails measuring the horizontal and vertical components of the RFI field (in units of relative decibels) received by an antenna positioned ten meters from the right and left hand sides of a vehicle. Noise readings are taken at suitable intervals over the frequency range of 20–1,000 MHz at bandwidths not greater than 1 MHz. The highest relative db signal measured at a particular frequency is recorded, and may be checked against the "quiet" radiation operating limit proscribed by the test. The electrode suppressed RFI signal generation to a level well below the acceptable noise limit according to the SAE J-551c test across the entire frequency range.

Thus, we have provided improved RFI quiet distributor rotor electrodes, the desirable effects of long life and reduced service wear being brought about by the incorporation therein of microscopic dielectric bodies with sponge-like or lacy structures. We have further provided a practical method of making such improved electrodes.

While the invention has been disclosed in terms of specific embodiments thereof, it will be appreciated that other forms could readily be adapted by one skilled in the art. Accordingly, the scope of the invention is to be considered limited only by the following claims.

The embodiments of the invention in which an exclusive property or privilege is claimed are defined as follows:

1. A method of making a dielectric containing material for suppressing radio frequency interference when incorporated in a conductive metal distributor rotor electrode, said method comprising:

melting a mixture comprising by weight at least half copper oxide and a minor portion of silicon oxide;

thereafter chemically reducing said copper oxide to copper metal without reducing said silicon oxide, the fused material in its solid state then being characterized by a first phase of lacy structured dielectric silica bodies mechanically interlocked with a second phase of reduced copper metal; and dispersing said fused material throughout a metal electrode such that the dielectric silica bodies comprise about 0.5 to 5 weight percent thereof.

2. A method of making a metal distributor rotor electrode containing dispersed dielectric material in the form of microscopic sponge-shaped bodies that are resistant to spark erosion and promote the suppression of radio frequency interference, the method comprising:

melting a mixture comprising a major phase consisting essentially of copper oxide and a minor phase consisting essentially of a constituent taken from the group consisting of silica or silica and alumina;

thereafter chemically reducing said copper oxide to copper metal without reducing the constituents of said minor phase, the fused mixture then being characterized by sponge-shaped dielectric silica bodies mechanically interlocked with the reduced copper metal matrix; and dispersing said fused mixture throughout a metal distributor rotor electrode such that the dielectric bodies comprise about 0.5 to 5 weight percent thereof.

3. A method of making a spark erosion resistant distributor rotor electrode containing microscopic dielectric bodies dispersed in an electrically conductive metal matrix for suppressing radio frequency interference, said method comprising;

melting a mixture consisting essentially of from about 65 to 95 weight percent copper oxide and the remainder a dielectric oxide taken from the group consisting of silica or mixtures of silica and alumina;

chemically reducing said copper oxide to copper metal without reducing said dielectric oxide, the composite material in the solid state then being characterized by lacy structured silica glass bodies with copper metal filling the interstices of said bodies;

comminuting said composite material to a powder; combining an amount of said composite powder with a powder of an electrically conductive metal or metals such that the dielectric silica based bodies comprise about 0.5 to 5 weight percent of the mixture;

pressing and sintering the mixture into a rotor electrode body such that the copper metal of said composite material fuses with said powder of the electrically conductive metal or metals.

* * * * *